United States Patent [19]

Pigott

[11] 4,262,513

[45] Apr. 21, 1981

[54] CONTINUOUS EXTRUSION OF METALS

[75] Inventor: Stanley W. Pigott, Haywards Heath, England

[73] Assignee: BICC Limited, London, England

[21] Appl. No.: 61,996

[22] Filed: Jul. 30, 1979

[30] Foreign Application Priority Data

Oct. 27, 1978 [GB] United Kingdom ..... 42280/78

[51] Int. Cl.[3] ..... B21C 23/32

[52] U.S. Cl. ..... 72/45; 72/60; 72/262; 72/270

[58] Field of Search ..... 72/44, 41, 42, 43, 45, 72/60, 262, 270

[56] References Cited

U.S. PATENT DOCUMENTS

| | | | |
|---|---|---|---|
| Re. 28,795 | 5/1976 | Fuchs | 72/60 |
| 3,740,985 | 6/1973 | Fuchs | 72/60 |
| 3,922,898 | 12/1975 | Voorhes | 72/43 |
| 4,027,514 | 6/1977 | Moreau | 72/60 |
| 4,041,745 | 8/1977 | Moreau | 72/60 |

FOREIGN PATENT DOCUMENTS 1488445 10/1977 United Kingdom .

OTHER PUBLICATIONS

The Reactor Group Report 2530(S), United Kingdom Atomic Energy Authority, Apr., 1974, "Conform—A New Concept for the Continuous Extrusion Forming of Metals", TRG Headquarters Risley Warrington WA3 6AT.

The Reactor Group Report 2945(S), United Kingdom Atomic Energy Authority, Apr., 1977, "The UKAEA 'Conform' Method of Continuous Extrusion Forming", TRG Headquarters Risley Warrington WA3 6AT.

*Primary Examiner*—Lowell A. Larson
*Assistant Examiner*—Gene P. Crosby
*Attorney, Agent, or Firm*—Buell, Blenko, Ziesenheim & Beck

[57] ABSTRACT

A method and apparatus are provided for continuously extruding rod feedstock through a die orifice while gripping two opposed sides of the feedstock to a pressure greater than the yield strength of the material with means for applying lubricant to the ungripped surfaces, constraining walls between which the feedstock is fed in the gripped condition, a stop at one end of the constraining walls, and a die orifice near the stop through which the feedstock is extruded, said lubricant applying means including at least two cylinders each having an open end facing a respective one of the ungripped surface when the apparatus is in use and means for introducing compressed gas into each of the cylinders.

3 Claims, 2 Drawing Figures

CONTINUOUS EXTRUSION OF METALS

This invention relates to a method of and apparatus for the continuous friction-effected extrusion of metals (including alloys and composite extrudable workpieces consisting in part of metal or alloy.)

One such technique, known in the industry as the "Linex" process, is described in U.K. patent specification 1,488,445 and entails gripping two opposed sides of a rod feedstock to a pressure greater than the yield strength of the material, lubricating the ungripped surfaces, providing opposed constraining walls and a stop at one end thereof, moving the feedstock in the gripped condition between the opposed walls to the stop where the feedstock upsets against the stop and constraining walls to pass out through a die orifice near the stop.

Since the lubricant must be confined exclusively to the ungripped surfaces, the lubricant must be sensibly solid, at least when applied, and it has been found that the consistent application of the correct amount of wax or other lubricant is critical to the satisfactory and efficient operation of the technique. When applying wax by rubbing a wax stick on the ungripped surfaces, it has been found that the stick may be so heated by friction that melting occurs and wax may get onto the surfaces that are to be gripped, and moreover it has been necessary, to maintain even rubbing pressure and so uniform coating, to straighten and guide the feedstock with much greater precision than would otherwise be required.

In the method of the present invention, wax or other suitable fusible solid lubricant is applied to each of the ungripped surfaces by supporting a respective stick of the lubricant in a cylinder having an open end facing the respective ungripped surface in which cylinder the stick is a loose sliding fit and introducing compressed air (or other gas) into the cylinder to apply a substantially constant biassing force urging the stick into engagement with the ungripped surface and at the same time (by leaking between the stick of lubricant and the cylinder) to cool the stick of lubricant to inhibit melting.

The invention includes apparatus for carrying out the method and including lubricant-applying means comprising at least two cylinders each having an open end facing a respective one of the ungripped surfaces (when the apparatus is in use) and means for introducing compressed gas into each of the cylinders.

Preferably there are two cylinders for each ungripped surface, to allow rapid deployment of a fresh stick of lubricant in place of one that is exhausted.

The sticks of lubricant, and consequently the cylinders, may be of circular, rectangular or other suitable cross-section.

A further benefit of the invention is that there is little friction between the cylinder and the lubricant stick and so the force applied can be very finely controlled.

Figure 1:
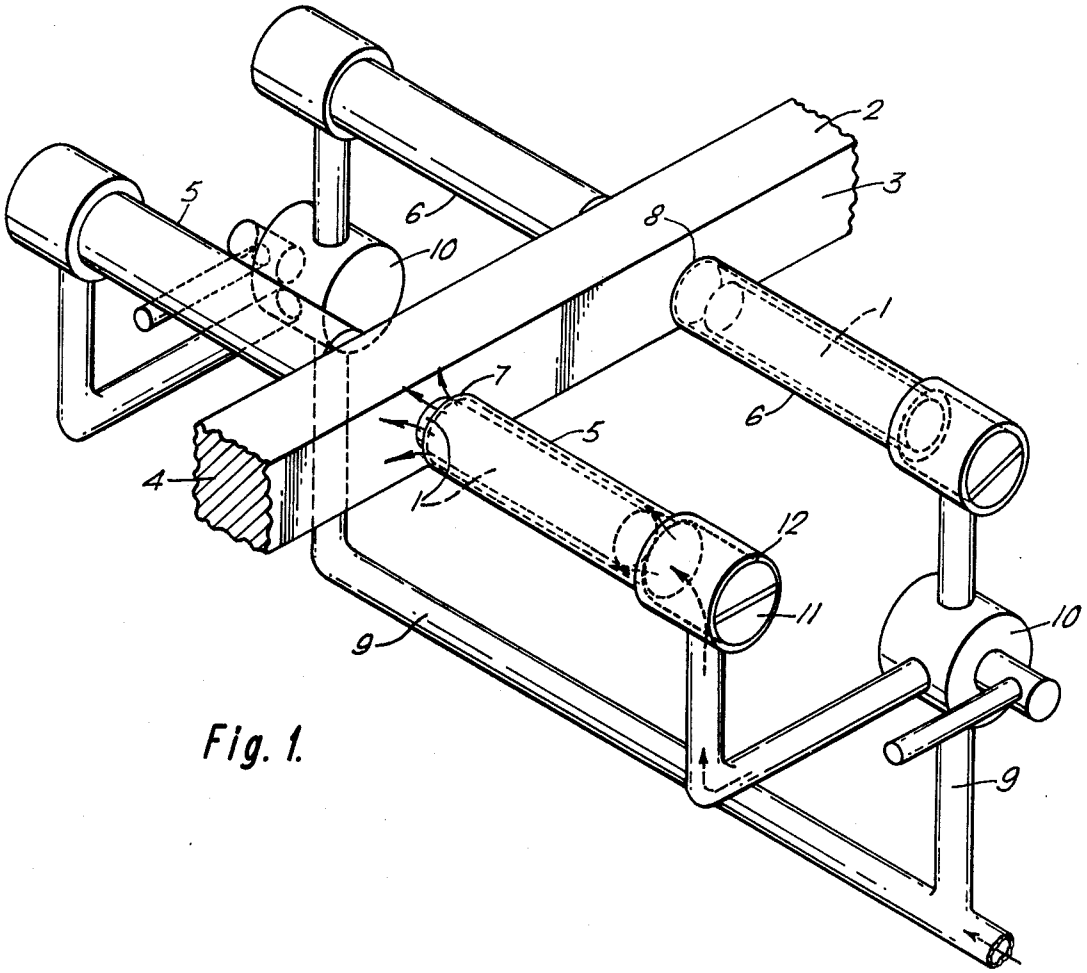
Figure 2:
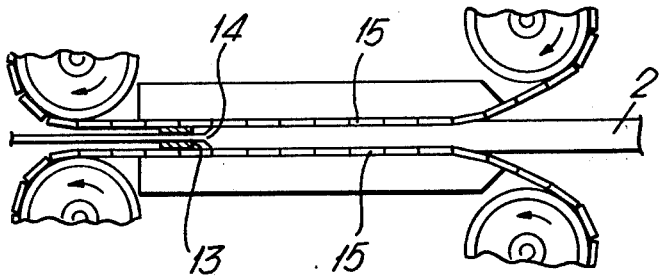

The invention is now described with reference to, and as shown in, the accompanying drawing in which:

FIG. 1 is a diagrammatic perspective view of one form of apparatus in accordance with the invention; and FIG. 2 is a diagrammatic partial cross-sectional view of the "Linex" apparatus.

Referring to FIG. 1, wax, in the form of a stick 1, is applied to the ungripped surfaces 3, 4 of a rectangular feedstock 2 before the feedstock is fed to a "Linex" extrusion apparatus, as shown in FIG. 2 in which the apparatus comprises a stop 13, a die orifice 14, and means 15 for gripping the opposed sides of the feedstock 2. The open ends 7, 8 of two cylinders 5, 6 face each ungripped surface 3, 4. The sticks 1 of wax are supported by and are a loose sliding fit in these cylinders 5, 6.

Compressed air is fed via pipes 9 and a two-way valve 10 to one of the cylinders 5. The air supplies a substantially constant biassing force urging the stick 1 of wax into engagement with the ungripped surface 3, 4 and at the same time leaks between the stick 1 of wax and the cylinder 5 to cool the wax to inhibit melting.

When the stick 1 of wax in cylinder 5 is exhausted the stick 1 of wax in cylinder 6 is rapidly brought into use by turning the two-way valve 10. A fresh stick 1 of wax can be inserted in cylinder 5 by unscrewing a cap 11 at the closed end 12 of the cylinder 5.

Although the drawing shows rectangular feedstock, this invention may also be applied to any other suitable cross-section of rod feedstock.

What we claim is:

1. A process of continuously extruding rod feedstock through a die orifice comprising the steps of gripping two opposed sides of the feedstock to a pressure greater than the yield strength of the material, lubricating the ungripped surfaces, providing opposed constraining walls and a stop at one end thereof, moving the feedstock in the gripped condition between the opposed walls to the stop where the feedstock upsets against the stop and constraining walls to pass out through the die orifice near the stop wherein the ungripped surfaces are lubricated by applying a fusible solid lubricant to each of them by supporting a respective stick of the lubricant in a cylinder having an open end facing the ungripped surface in which cylinder the stick is a loose sliding fit and introducing compressed gas into the cylinder to apply a substantially constant biassing force urging the stick into engagement with the ungripped surface and at the same time to cool the stick of lubricant to inhibit melting.

2. Apparatus for continuously extruding rod feedstock comprising means for gripping two opposed sides of the feedstock to a pressure greater than the yield strength of the material; means for applying lubricant to the ungripped surfaces; constraining walls between which the feedstock is fed in the gripped condition; a stop at one end of the constraining walls; and a die orifice near the stop, through which the feedstock is extruded; wherein said lubricant—applying means comprises at least two cylinders each having an open end facing a respective one of the ungripped surface when the apparatus is in use and means for introducing compressed gas into each of the cylinders.

3. Apparatus as claimed in claim 2 including two cylinders for each ungripped surface.

* * * * *